US005582582A

United States Patent [19]

Chapman

[11] Patent Number: 5,582,582

[45] Date of Patent: Dec. 10, 1996

[54] BACK MASSAGING MECHANISM

[76] Inventor: Nicki C. Chapman, 74 Blue Ridge Dr., Levittown, Pa. 19057

[21] Appl. No.: 440,669

[22] Filed: May 15, 1995

[51] Int. Cl.[6] ..... A61H 15/00

[52] U.S. Cl. ..... 601/112; 601/136; 601/117; 601/113; 601/103

[58] Field of Search ..... 601/97–99, 101–103, 601/107–117, 133, 134, 136, 84, 146

[56] References Cited

U.S. PATENT DOCUMENTS

| | | | |
|---|---|---|---|
| 1,609,796 | 12/1926 | Cheney | 601/112 |
| 1,709,170 | 4/1929 | Hassler | 601/103 |
| 2,714,381 | 8/1955 | Corley et al. | 601/134 |
| 3,403,674 | 10/1968 | Alimanestiano | 601/134 |
| 3,898,985 | 8/1975 | Butcher et al. | 601/101 X |
| 4,041,938 | 8/1977 | Wintoniw | 601/101 |
| 4,632,094 | 12/1986 | Thomas | 601/97 |
| 4,721,100 | 1/1988 | Hengl | 601/117 |
| 4,960,110 | 10/1990 | Yamasaki | 601/102 |
| 5,022,386 | 6/1991 | Kuniskis | 601/117 |
| 5,477,491 | 9/1995 | Bellandi | 601/112 |

FOREIGN PATENT DOCUMENTS

| | | | |
|---|---|---|---|
| 99208 | 9/1898 | Germany | 601/112 |
| 2905383 | 8/1980 | Germany | 601/117 |
| 405161690 | 6/1993 | Japan | 601/84 |
| 303825 | 2/1955 | Switzerland | 601/117 |

*Primary Examiner*—Robert A. Hafer
*Assistant Examiner*—Brian E. Hanlon

[57] ABSTRACT

A back massaging mechanism for massaging a user's back including a first pair of spaced parallel bars; a pair of downwardly extending telescopic legs coupled to each bar and positionable upon a recipient surface to thereby create a space for accommodating a user lying in a generally horizontal position with his back facing upwards; an elongated cross rail extended between the bars; a guiding mechanism for guiding movement of the cross rail along the bars; a massaging mechanism including a housing coupled to the cross rail for longitudinal slidable moveable therealong, a plurality of rotatable heads with extending fingers coupled to and projected downwards from the housing and with the fingers of the heads positionable upon the user's back, and a first drive mechanism for moving the housing along the cross rail and for simultaneously rotating the heads; and a second drive mechanism for moving the cross rail along the bars and with the fingers of the heads thus longitudinally and transversely moveable for massaging an extent of the user's back.

1 Claim, 4 Drawing Sheets

BACK MASSAGING MECHANISM

BACKGROUND OF THE INVENTION

1. Field of the Invention

The present invention relates to a back massaging mechanism and more particularly pertains to massaging a user's back with a back massaging mechanism.

2. Description of the Prior Art

The use of massaging systems is known in the prior art. More specifically, massaging systems heretofore devised and utilized for the purpose of massaging a user are known to consist basically of familiar, expected and obvious structural configurations, notwithstanding the myriad of designs encompassed by the crowded prior art which have been developed for the fulfillment of countless objectives and requirements. While the heretofore devised massaging systems fulfill their respective, particular objectives and requirements, none provide a back massaging mechanism that allows automatic transverse and longitudinal massaging motion for massaging a user's back.

In this respect, the back massaging mechanism according to the present invention substantially departs from the conventional concepts and designs of the prior art, and in doing so provides an apparatus primarily developed for the purpose of massaging a user's back.

Therefore, it can be appreciated that there exists a continuing need for new and improved back massaging mechanism which can be used for massaging a user's back. In this regard, the present invention substantially fulfills this need.

SUMMARY OF THE INVENTION

In the view of the foregoing disadvantages inherent in the known types of massaging systems now present in the prior art, the present invention provides an improved back massaging mechanism. As such, the general purpose of the present invention, which will be described subsequently in greater detail, is to provide a new and improved back massaging mechanism and method which has all the advantages of the prior art and none of the disadvantages.

To attain this, the present invention essentially comprises, in combination, a table including a rectangular border section formed of a pair of long bars interconnected between a pair of short bars to create a central rectangular space. The table additionally includes four downwardly extending telescopic legs with each leg coupled to the border section at a location near a separate corner thereof for supporting the table in a generally level elevated orientation above a recipient surface. The legs are telescopically adjustable for creating a space between the border section and the recipient surface for accommodating a user lying in a generally horizontal position with his back facing upwards. A pair of moveable chains loops are included with each chain loop longitudinally positioned about a separate long bar and with each chain loop further being guided by a plurality of guiding brackets that are coupled to the table. An elongated cross rail is included and extended across the central space of the border section and with each end thereof coupled to one of the chain loops.

A massaging mechanism is provided and includes a hollow housing positioned under and coupled to the cross rail with a brace for slidable longitudinal movement with respect thereto, a plurality of replaceable rotatable spring-loaded heads with downwardly extending fingers coupled to and projected downwards from the housing and with the fingers of the heads positionable upon the user's back, and electrically energizeable first drive means disposed within the housing for moving the housing along the cross rail and for simultaneously rotating the heads. Lastly, an electrically energizeable second drive means is included. The second drive means is coupled to an upper extent of one of the legs and engaged with the adjacently located chain loop for moving the cross rail along the long bars of the border section. The fingers of the heads are thus longitudinally and transversely moveable for massaging an entire extent of the user's back.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved back massaging mechanism which has all the advantages of the prior art massaging systems and none of the disadvantages.

It is another object of the present invention to provide a new and improved back massaging mechanism which may be easily and efficiently manufactured and marketed.

It is a further object of the present invention to provide a new and improved back massaging mechanism which is of durable and reliable construction.

An even further object of the present invention is to provide a new and improved back massaging mechanism which is susceptible of a low cost of manufacture with regard to both materials and labor, and which accordingly is then susceptible of low prices of sale to the consuming public, thereby making such a back massaging mechanism economically available to the buying public.

Still yet another object of the present invention is to provide a new and improved back massaging mechanism which provides in the apparatuses and methods of the prior art some of the advantages thereof, while simultaneously overcoming some of the disadvantages normally associated therewith.

Even still another object of the present invention is to provide a new and improved back massaging mechanism for massaging a user's back.

Lastly, it is an object of the present invention to provide a new and improved back massaging mechanism comprising a first pair of spaced parallel bars; a pair of downwardly extending telescopic legs coupled to each bar and positionable upon a recipient surface to thereby create a space for accommodating a user lying in a generally horizontal position with his back facing upwards; an elongated cross rail extended between the bars; guiding means for guiding movement of the cross rail along the bars; a massaging mechanism including a housing coupled to the cross rail for longitudinal slidable moveable therealong, a plurality of rotatable and spring-loaded heads with extending fingers coupled to and projected downwards from the housing and with the fingers of the heads positionable upon the user's back, and first drive means for moving the housing along the cross rail and for simultaneously rotating the heads; and second drive means for moving the cross rail along the bars and with the fingers of the heads thus longitudinally and transversely moveable for massaging an extent of the user's back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
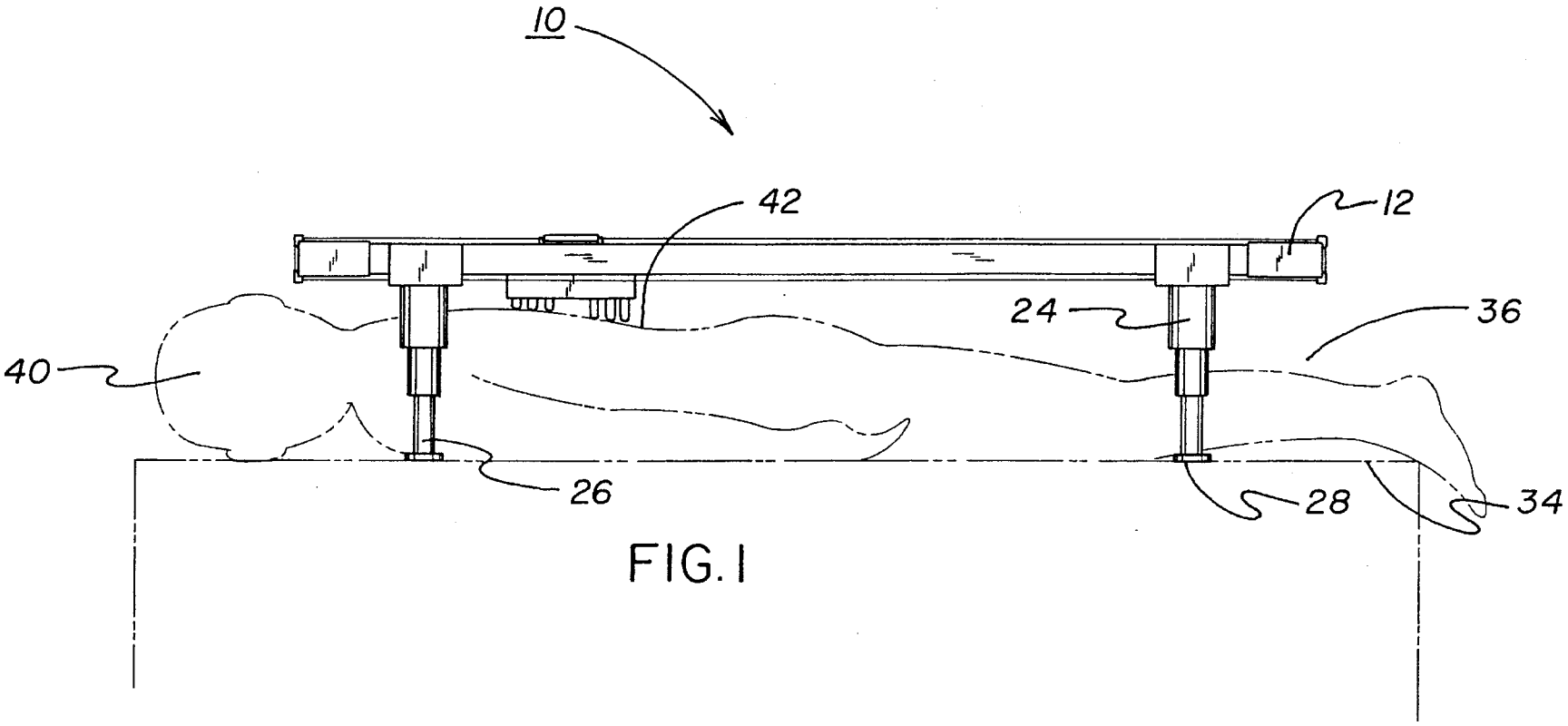
FIG. 1 is a side-elevational view of the preferred embodiment constructed in accordance with the principles of the present invention.
Figure 2:
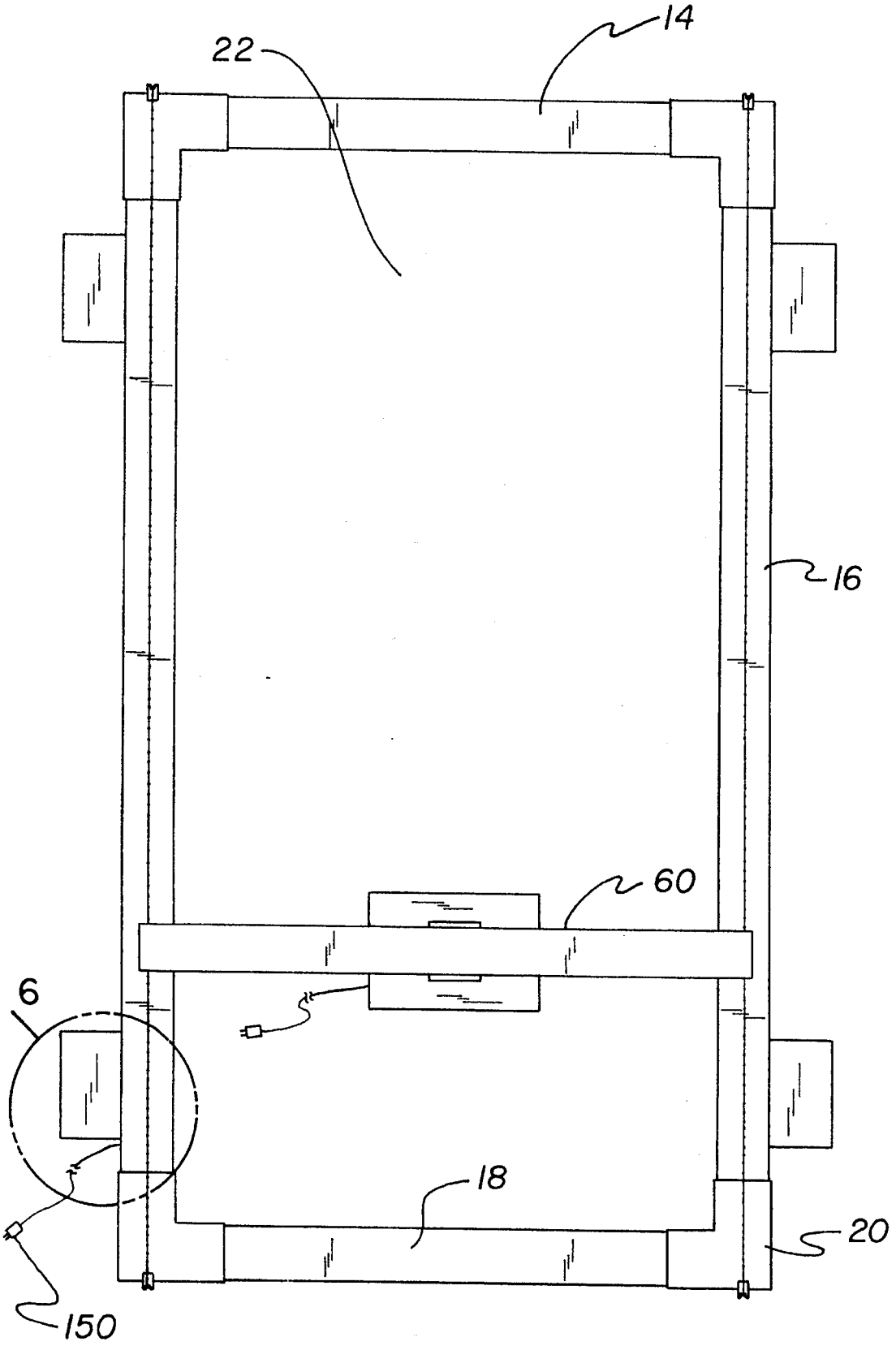
FIG. 2 is a plan view of the preferred embodiment of the present invention.
Figure 3:
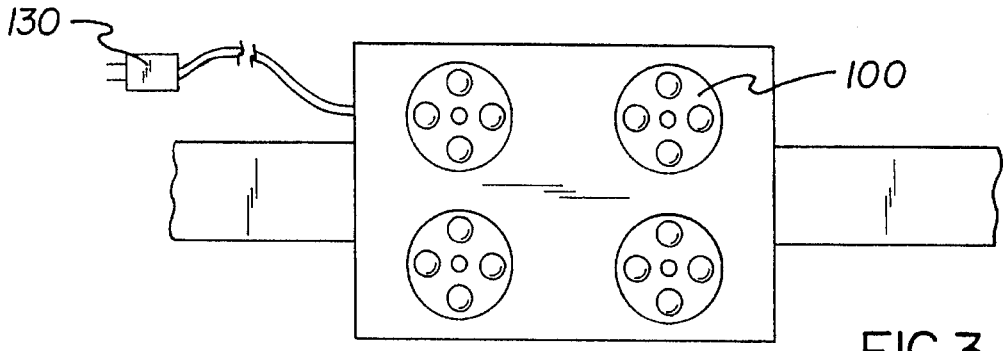
FIG. 3 is a view of the massaging heads of the present invention.
Figure 4:
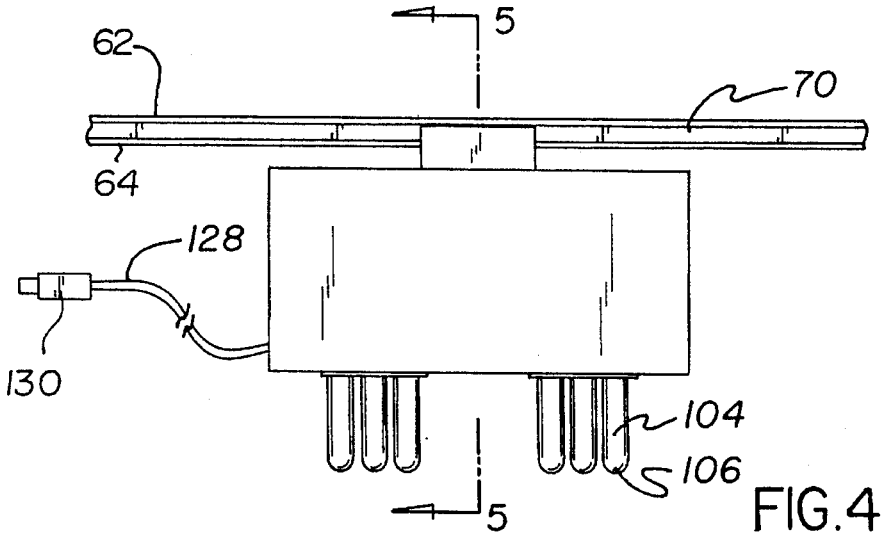
FIG. 4 is a side-elevational view of the massaging mechanism and its slidable coupling to the cross rail of the present invention.
Figure 5:
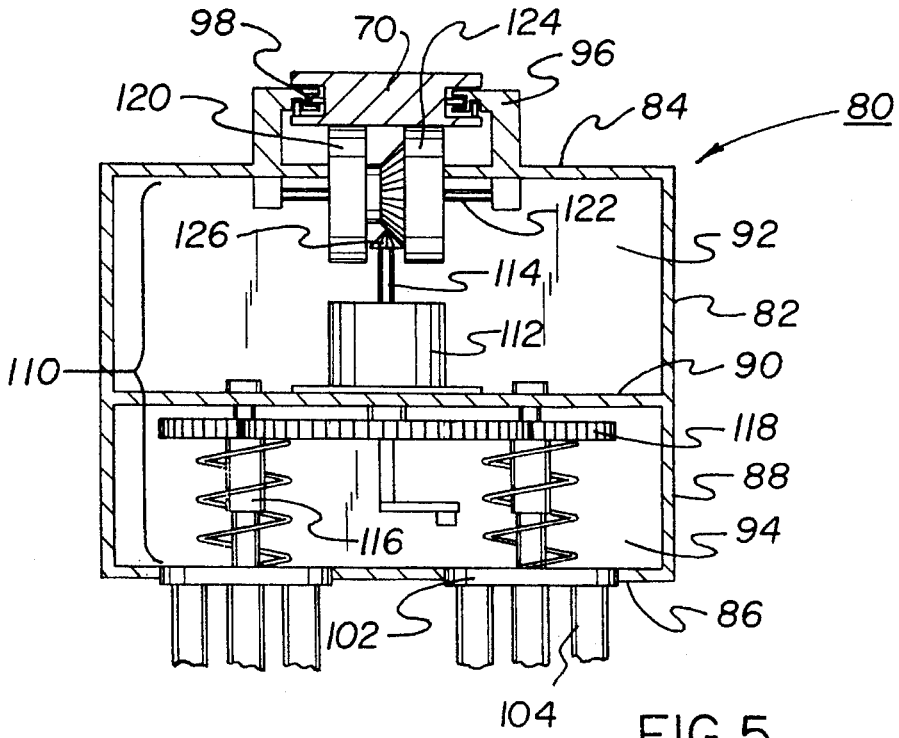
FIG. 5 is a cross-sectional view of the present invention taken along the line 5—5 of FIG. 4.
Figure 6:
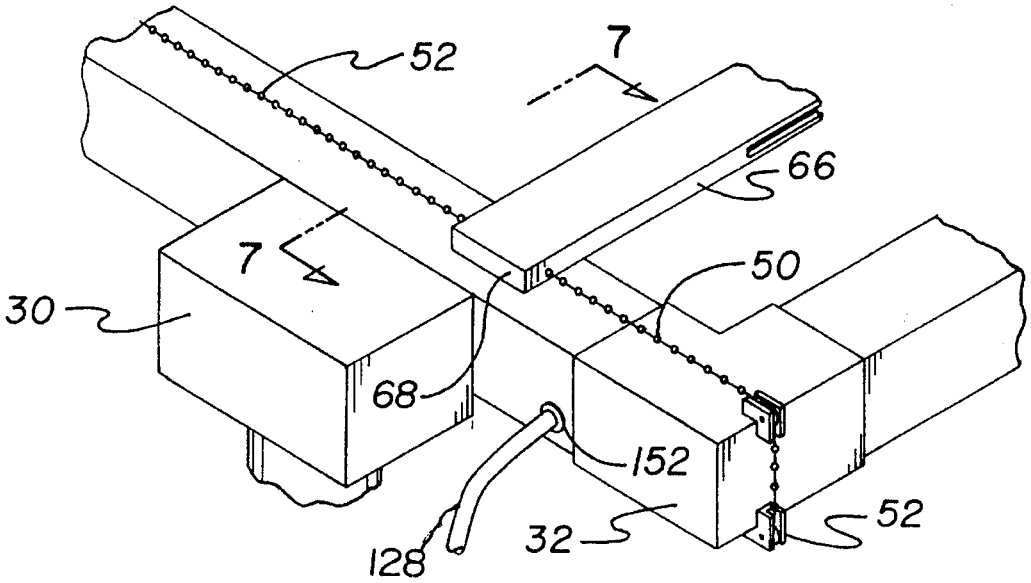
FIG. 6 is an enlarged fragmentary view of a corner of the border section of the present invention.
Figure 7:
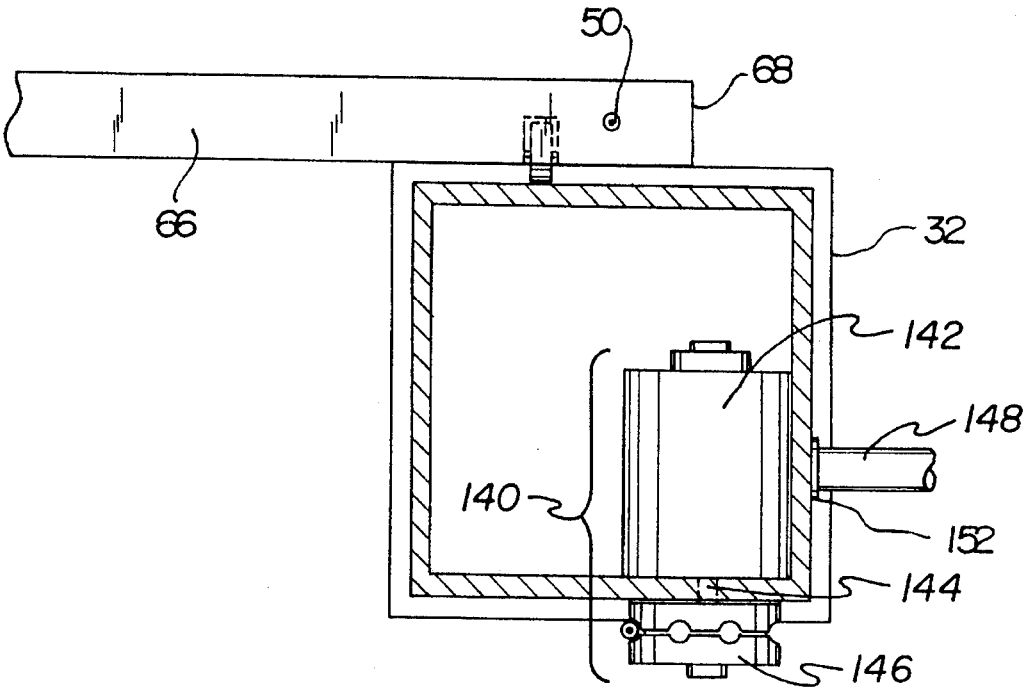
FIG. 7 is a cross-sectional view of the present invention taken along the line 7—7 of FIG. 6.

With reference now to the drawings, and in particular, to FIG. 1 thereof, the preferred embodiment of the new and improved back massaging mechanism embodying the principles and concepts of the present invention and generally designated by the reference number 10 will be described.

The preferred embodiment of the present invention comprises a plurality of components. In their broadest context, such components include a elevated frame, massaging mechanism and drive mechanisms. Such components are individually configured and correlated with respect to each other to provide the intended function of massaging a user's back.

Specifically, the present invention includes a elevated frame 12. The elevated frame is formed of a rigid material such as metal or plastic. The elevated frame includes a rectangular border section 14. The border section 14 is formed of a pair of long bars 16 to which are connected a pair of short bars 18 with four L-shaped elbows 20. Each bar has a rectangular cross-section. The border section has a central rectangular space 22 that is formed between the connected long bars 16 and short bars. The elevated frame additionally includes four downwardly extended and telescopic legs 24. Each leg is formed of three sections 26. The lowermost section of each leg is terminated with a disk-shaped foot 28. Each leg has an upper block-shaped end 30 coupled to the border section at a location near a separate corner 32 that is defined by an elbow 20. The legs support the elevated frame in a generally level elevated orientation above a recipient surface 34. The legs are telescopically adjustable for creating a space 36 between the border 14 and the recipient surface 34 for accommodating a user 40 who is laying in a generally horizontal position with his back 42 facing upward.

A pair of movable flexible chain loops 50 are provided. Each chain loop is formed of a plurality of interconnected links 52. Each chain loop is further longitudinally positioned about a separate long bar 16 and is guided by a plurality of rigid guiding brackets 52. The guiding brackets 52 are coupled to the elbows 20 of the table 12.

Extended across the central space 22 of the border is a cross-rail 60. The cross-rail is elongated and rectangular in structure. It is formed of a rigid metal or plastic material. The cross-rail has an upper surface 62, a lower surface 64, and a periphery interconnecting the surfaces 62, 64 formed of a pair of opposed long edges 66 and a pair of opposed short edges 68. Each long edge further has a longitudinal groove 70 formed thereon. Each end of the cross-rail is coupled to one of the chain loops 50.

To provide massaging action, a massaging mechanism 80 is provided. The massaging mechanism includes a hollow housing 82. The housing is formed of a rigid material such as metal or plastic. The housing has a rectangular cross-section and is formed of an upper wall 84, a lower wall 86, and a peripheral side wall 88 interconnecting the walls 84, 86. A generally horizontal inner wall 90 is extended across the interior of the housing to create an upper compartment 92 and a lower compartment 94. The housing is positioned under and coupled to the cross-rail 60 with a brace 96 that is coupled to the upper wall 84. The brace has opposing arms 98 that are engaged in the grooves 70 of the cross-rail 60 for allowing slidable movement of the housing along a longitudinal extent of the cross-rail. Four replaceable and rotatable heads 100 are included. Each head has a disc-shaped upper extent 102 with four downwardly extending fingers 104. Each finger is terminated with a rounded tip 106. The fingers can be formed of a generally rigid or a flexible material. The heads are coupled to and projected downwards from the housing 82. The tips of the fingers of the heads are positionable upon a user's back 42. The heads are rotatable through an electrically energizeable first drive mechanism 110. The first drive mechanism is disposed within the housing and is used for moving the housing along the cross-rail and for simultaneously rotating the heads. The first drive mechanism includes a motor with a fixed stator 112 and a rotatable rotor 114. Four rigid shafts 116 are included. Each shaft is extended downward and is coupled to the upper extent 102 of a separate head The rotor 114 is engaged with the shaft 116 through gears 118 located in the second compartment. Within the upper compartment 92, a wheel 120 is coupled to the housing with an axle 122 and is engaged with the cross-rail. The wheel is rotatable through actuation of a major beveled gear 124 coupled to the axle 122. The major beveled gear 124 is rotatable through a minor beveled gear 126 coupled to the rotor 114 of the motor The motor is electrically energized through a power cord 128 terminated with a pronged plug 130. Plug 130 is removably securable to an external source of electrical power such as that available through a common household electrical receptacle.

Lastly, an electrically energizeable second drive mechanism 140 is included. The drive mechanism is coupled to an upper extent 30 of one of the legs and is engaged with the adjacently located chain 50. The drive means is used for moving the cross-rail along the long bars of the border section. The drive mechanism 140 is formed of a motor having a fixed stator 142 and a rotatable rotor 144. The rotor 144 is coupled to a sprocket 146 that is engaged with chains 50. The motor is provided with electrical energy through a power cord 148 extended from the stator 142 and back fit with a grommet 152. A distal end of the power cord 148 has a plug 150 secured thereto. The plug is insertable within a common electrical receptacle for receiving electrical power. Thus, through active engagement of the first drive mechanism 110 and the second drive mechanism 140, the fingers of the head are both longitudinally and transversely movable for massaging an entire extent of the user's back.

The present invention features telescopic legs for adjusting the height of the table for massage a specific part of a user's body. The fingers are approximately¾ inches in length. The heads can be formed of a hard or a soft material. To use the present invention, a user lies flat on his stomach and positions the fingers of the heads upon his back. The drive mechanisms are then activated for allowing both a transverse and longitudinal extent of the user's back to be massaged or scratched. The present invention allows stress and pain to be reduced or alleviated through the massaging action provided. In addition, a heat-penetration mechanism can be fitted upon the heads for allowing a warm massaging action.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A back massaging mechanism for massaging a user's back comprising, in combination:

an elevated frame including a rectangular border section formed of a pair of long bars interconnected between a pair of short bars to create a central rectangular space and a generally planar configuration, the elevated frame additionally including four downwardly extending telescopic legs with each leg coupled to the border section at a location near a separate corner of the frame for supporting the elevated frame in a generally level elevated orientation above a recipient surface and with the legs telescopically adjustable for creating a space between the border section and the recipient surface for accommodating a user lying in a generally horizontal position with his back facing upwards, each leg being formed of three sections, a lowermost section of said three sections of each leg terminating with a disk-shaped foot, each leg having an upper block-shaped end coupled to the border section of the frame;

a pair of moveable chains loops with each chain loop longitudinally positioned about a separate long bar and with each chain loop further being guided by a plurality of guiding brackets that are coupled to the elevated frame;

an elongated cross rail extended across the central space of the border section and with each end of the cross rail coupled to one of the chain loops;

a massaging mechanism including a housing having an internal area positioned under and coupled to the cross rail with a brace for slidable longitudinal movement with respect to the cross rail, a plurality of replaceable rotatable spring-loaded heads with downwardly extending flexible fingers coupled to and projected downwards from the housing with the fingers of the heads positionable upon the user's back, and electrically energizeable first drive means disposed within the housing for moving the housing along the cross rail and for simultaneously rotating the heads; and electrically energizeable second drive means coupled to an upper extent of one of the legs and engaging the adjacently located chain loop for moving the cross rail along the long bars of the border section and the fingers of the heads are longitudinally and transversely moveable for massaging an entire extent of the user's back.

* * * * *